US006320970B1

(12) United States Patent
Czerwinski et al.

(10) Patent No.: US 6,320,970 B1
(45) Date of Patent: Nov. 20, 2001

(54) HIGH FREQUENCY COMPRESSION DRIVERS

(76) Inventors: Eugene J. Czerwinski, 555 Easy St.; Alexander G. Voishvillo, 1216 Patricia Ave., both of Simi Valley, CA (US) 93065

( * ) Notice: Subject to any disclaimer, the term of this patent is extended or adjusted under 35 U.S.C. 154(b) by 0 days.

(21) Appl. No.: 09/397,407

(22) Filed: Sep. 16, 1999

Related U.S. Application Data

(63) Continuation-in-part of application No. 09/161,554, filed on Sep. 25, 1998, now abandoned.

(51) Int. Cl.[7] ..... H04R 25/00

(52) U.S. Cl. ..... 381/343; 381/430; 381/340; 381/398

(58) Field of Search ..... 381/339, 340, 381/341, 342, 343, 398, 423, 424, 430, FOR 143; 181/152, 157, 159, 187, 192, 193, 194, 195

(56) References Cited

U.S. PATENT DOCUMENTS 2,058,208 * 10/1936 Blattner ..... 181/159
5,875,252 * 2/1999 Lesage ..... 381/340

* cited by examiner

*Primary Examiner*—Huyen Le
(74) *Attorney, Agent, or Firm*—W. Edward Johansen

(57) ABSTRACT

The compression driver includes an annular diaphragm with a voice coil which is disposed in a magnetic gap of a magnet assembly which supplies a magnetic field to the voice coil. The annular diaphragm has a first support portion, a second support portion, a first curved resilient portion, a second curved resilient portion and a voice coil support portion which is disposed between the first and second resilient curved portions. The voice coil is wound on the voice coil support portion. The voice coil is disposed in the magnetic gap of the magnet assembly. The compression driver also includes an inner support ring and an outer support ring. The inner support ring has a bottom surface with a first curved groove. The outer support ring has a bottom surface with a second curved groove and is disposed concentrically around the inner support ring.

3 Claims, 8 Drawing Sheets

Fig. 5.
(PRIOR ART)
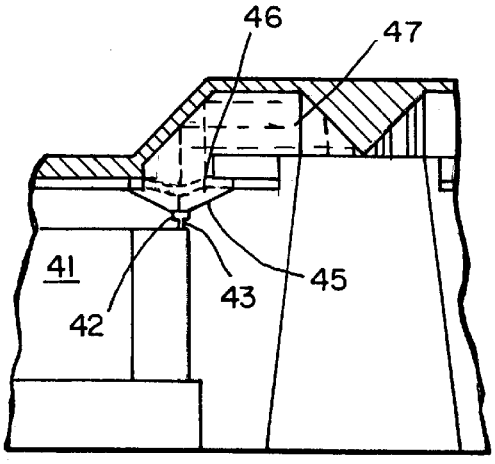
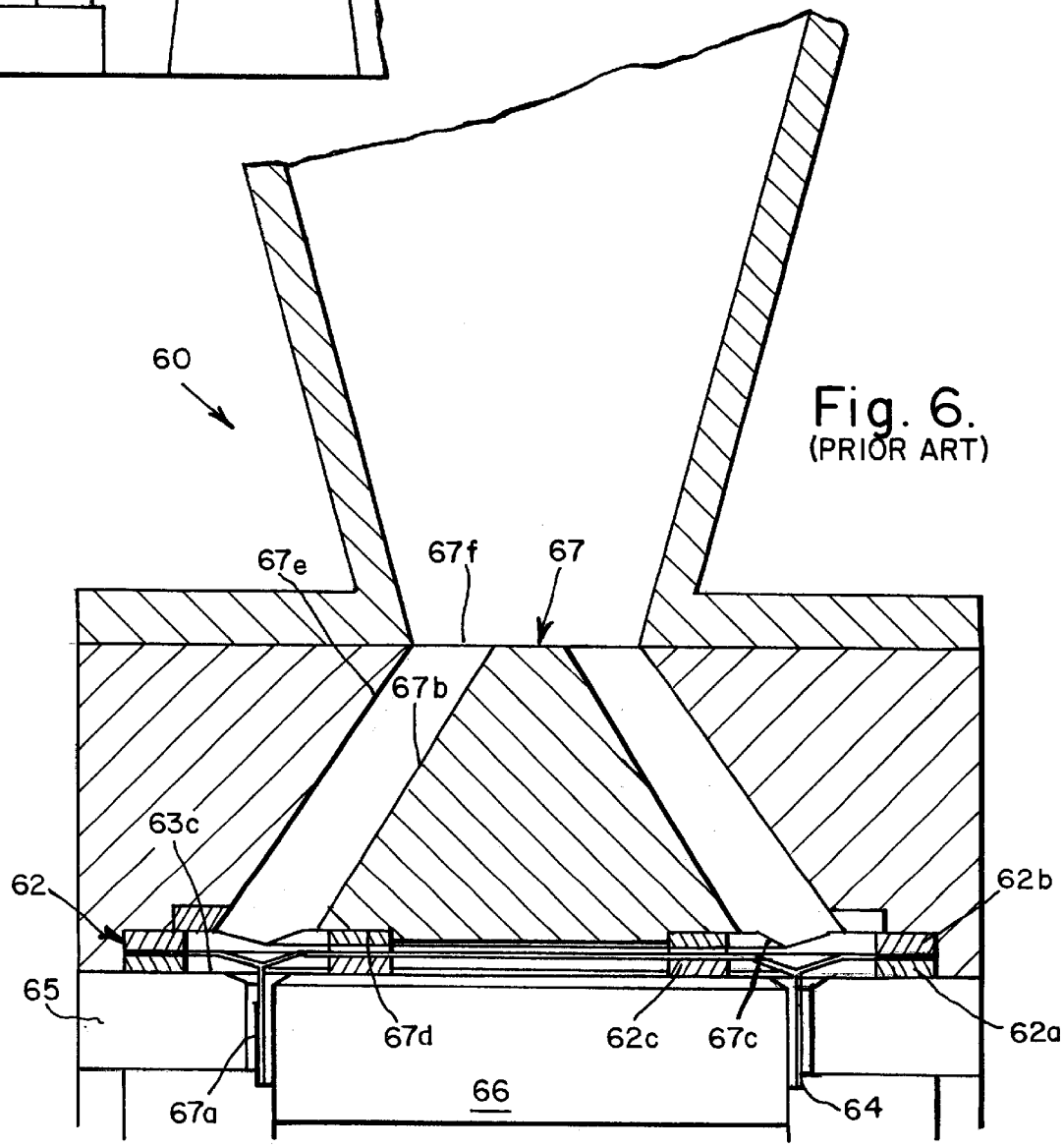
Fig. 6.
(PRIOR ART)

HIGH FREQUENCY COMPRESSION DRIVERS

This is a continuation-in-part of application filed Sep. 25, 1998 under Ser. No. 09/161,554 now abandoned.

BACKGROUND OF THE INVENTION

The invention relates to high frequency compression drivers. Compression driver is an electro-mechano-acoustical transducer of electrodynamic type that converts electrical audio signal into an acoustical signal.

Electro-dynamic transducers that turn an electrical signal into radiated acoustical sound waves are well known. Such devices are generally broken down into two categories: direct radiating electro-dynamic loudspeakers, which directly radiate the generated sound waves into open air, and indirect radiators (consisting of horns and horn drivers, that are also called compression drivers), which require additional elements such as compression chamber, a phasing plug and a horn.

In a direct-radiating loudspeaker, the diaphragm, which is driven by the voice coil, vibrates and excites the particles of the surrounding air to generate the sound waves related to the input electrical signal. Low efficiency of direct radiating loudspeakers as well as the lack of controlled directivity of radiated acoustic energy make them impractical for use in sound systems requiring high sound pressure levels and controlled directivity.

Generally, compression drivers can generate much higher sound pressure levels when compared with direct radiators and are used, predominantly in sound reinforcement and in public address systems, where the loud sound signals are of essence.

In horn loudspeakers, such as compression drivers, the diaphragm moves against a surface closely spaced thereto and generates high-pressure acoustical waves which are passed through a phasing plug to a horn. Phasing plug is essentially an acoustical adapter that connects the air volume in front of the diaphragm (called compression chamber) to the input (throat) of the horn. Phasing plug has one or several inlets with overall area smaller than that of the diaphragm. Smaller area of the inlets of the phasing plug provides air compression and the increase of the sound pressure in the compression chamber therefore increasing efficiency of the transformation of mechanical energy of the moving diaphragm into the acoustical energy of a sound signal. The phasing plug is also used to reduce the volume of air to be compressed by the vibrating diaphragm to decrease the parasitic compliance of the air in compression chamber to prevent attenuation of high frequency signals. The phasing plug is also used to cancel high frequency standing waves in air chamber through carefully positioned passageways or holes through the phase plug, and it also used to eliminate certain interfering cancellations in the generated sound waves.

The phasing plug conveys the sound signal into the horn and is essentially the beginning of the horn. The horn provides transformation of a high sound pressure level signal at the throat into a lower sound pressure signal at the mouth of the horn. The horn with a phasing plug at its beginning is essentially an acoustical transformer which matches high mechanical impedance of the vibrating diaphragm to the low impedance of open air.

A horn speaker introduces distortions at high output levels which are perceived by a listener as a lack of quality and clarity of sound. The distortions of a horn speaker are caused by several reasons. Distortion may occur due to the high and non-symmetrical mechanical stiffness of the suspension of the diaphragm. This distortion is dependent on the amplitude of the excursion of the diaphragm. Since the amplitude of the excursion increases at lower part of the frequency range of the driver, the level of this distortion also increases at low frequencies. Great deal of distortion is generated in the compression chamber because of the non-linear nature of the compression of air. Strictly speaking, there are two air chambers in a compression driver. The chamber in front of the diaphragm, namely compression chamber, is open into the horn through the orifices in the phasing plug. The chamber behind the diaphragm, called rear chamber or back chamber, is usually sealed. In spite of the similar basic nature of the air compression-related distortion in front and rear chambers, its behavior is different. The air trapped in the back chamber acts merely as a non-linear spring, somewhat similar to the non-symmetrical mechanical suspension of the diaphragm. The air in the front chamber is also non-linearly compressed during the operation of the driver, but since the front compression chamber is open into the horn, the process of compression is more complicated and so is the behavior of the corresponding distortion.

In order to understand the non-linear behavior of air enclosed in a chamber, one may consider that the diaphragm acts as a piston, reciprocating in a cylinder, which is either closed, which is typical for the rear chamber, or has an orifice of an area which is equal to the entrance of the phasing plug (this holds true for the front chamber). For adiabatic change of pressure which occurs in the cylinder, which is a compression chamber, the relationship between the total pressure and volume in the cylinder is expressed by the Boyle's law, $(P_0+P(t))\ (V_0-V(t))^{\gamma}=P_0V_0=\text{const}$ , where $P_0$ is atmospheric pressure, $V_0$ is the initial volume, P(t) is the instantaneous change of the pressure in the cylinder, V(t) is the change of the volume of the cylinder, and $\gamma=1.4$ is the ratio of the specific heat of the air at constant pressure to the specific heat at constant volume. As the cylinder reciprocates with equal displacement on either side of the initial reference position, the minimum and maximum values of the displacement and correspondingly, the volume, cause non-equal changes of pressure around its initial value $P_0$. The positive change of the pressure (this corresponds to decrease of the volume) has higher amplitude than the negative change of the pressure, which corresponds to the increase of the volume. For a sealed cylinder, the volume V is expressed as $V(t)=X_d(t)S_d$ where $X_d$ is the displacement of the cylinder (diaphragm), $S_d$ is the area of the cylinder (diaphragm). For the partly open cylinder, the front chamber, the change of the volume is expressed as $V(t)=X_d(t)S_d-X_t(t)S_t$ where $X_t$ is the displacement of the air particles at the orifice of the cylinder at the entrance of the phasing plug and $S_t$ is the area of the orifice. The air in the front chamber is partly compressed and partly displaced into the entrance of the phasing plug to propagate down the horn to be radiated from the mouth of the horn. Input acoustical impedance of the horn with the phasing plug being at the beginning of the horn is frequency-dependent. It is essentially zero at low frequencies, and then it grows with frequency and reaches the constant value $$Z=\frac{\rho c}{S_t},$$

where ρ is the air density, c is the speed of sound, and $S_t$ is the area of the entrances in the phasing plug. At low frequencies the compression chamber is practically open, there is no air compression and no air-related distortion occurs. At higher frequencies the impedance increases and the chamber gets "closed" (not completely though), and the pressure inside the chamber increases. As the compression of the air increases the distortion grows. Therefore, the distortion increases with frequency until the impedance of the horn reaches its maximum constant value. Obviously, the distortion also grows with the increase of pressure in the chamber. The smaller area of the entrances in the phasing plug causes higher pressure in the chamber, and correspondingly, higher level of air compression-related distortion. To decrease the level of air compression distortion in the rear chamber, its volume should be large as compared to the displacement volume of the diaphragm. Opening in the back chamber decreases the pressure in the back chamber and, correspondingly, decreases the level of distortion. Rear chamber can be opened into the cavity underneath the top plate, between the magnet and the pole piece.

The level of air compression distortion in the front chamber is a compromise with the efficiency of the compression driver as well as the level of high frequency signal. The distortion can be minimized by increasing the volume of the front chamber or the area of the openings of the phasing plug. However, the increase of volume always brings the level of high frequency signal down, and the increase of the area of the openings of the phasing plug may decrease the efficiency of the driver.

While a phasing plug is generally essential to the efficiency of a compression driver, a phasing plug is the direct cause of several problems in compression drivers. Since several paths of different length may extend from the outer periphery of the diaphragm to the horn throat, (this is typical for phasing plug placed over the convex surface of a dome diaphragm) by way of the phasing plug, the generated sound wave at the throat of the horn may be distorted due to the phasing problems. Cancellation of acoustical signal at certain frequencies may occur. In addition, since the phasing plug must be located close to the diaphragm (in order to minimize the volume of air in compression chamber) excursions of the diaphragm are limited and reproduction of low frequency signal is compromised because the displacement of the diaphragm increases at low frequencies.

Finally, the upper frequency range of typical compression devices is limited to about 14–16kHz. The limitation is explained by the inertia due to the mass of the moving diaphragm, by the increase of impedance of the inductance of the voice-coil, by the parasitic compliance of the air in compression chamber and by the occurrence of high frequency acoustic resonances in the compression chamber that cause notches on the frequency response. It is desirable that the path lengths from all portions of the diaphragm to the throat of the horn be equal to produce sound waves of the same phase at the throat. To prevent this cancellation of high frequency signal at output the differences in path lengths from the diaphragm to the throat of the horn should not exceed a quarter wavelength of the highest frequency of the signal.

In all compression drivers the dome is attached to a mounting ring or base via a compliant material known as surround of the diaphragm. The surround allows the dome to move up and down in response to the electrical signal fed to the voice coil and centers the dome both vertically and horizontally.

An important aspect of the performance of the diaphragm at high frequency is the mechanical high frequency resonances of the dome which occur well above the low frequency fundamental resonance of the mass of the diaphragm and compliance of the surround. If the diaphragm is driven at the high frequency resonances, it will produce a greater output than it will if it is driven at a somewhat higher or a somewhat lower frequency. Therefore the high frequency mechanical resonances of the diaphragm can be utilized to partially offset the mass-induced high frequency roll-off and thereby extend the useful range of a compression driver.

Resonance frequencies are dependent upon the physical properties of the material of the diaphragm and curvature of the dome. These frequencies can be estimated from the properties of the material and the curvature and length of the spherical section. Some of the materials used for construction of dome diaphragm for high frequency compression drivers include aluminum, beryllium, and titanium. Heat-treatable aluminum is a reasonable compromise for the dome diaphragm, since it is light-weight, relatively stiff, has a high fatigue strength, and has a high damping tendency that turns part of the unavoidable distortion of the moving diaphragm into heat, rather than into distorted sound.

The requirement for high frequency response coupled with high power handling presents a formidable challenge for loudspeaker designers. High frequency performance requires light, low mass diaphragm and voice coils. High power handling capacity is better provided by substantial coils and diaphragms which because of their high mass are inefficient at higher frequencies. The mid to high frequency range is usually divided into two bands and covered by two physically different driver units. The lower end (mid-range) is serviced by drivers with relatively heavy diaphragm assemblies. The high end is covered by drivers equipped with light diaphragms and small diameter coils. Several smaller drivers are required to match the output of each large mid-range unit. The solution is reliable, but not altogether satisfactory because of the obvious penalties in cost, size and weight.

Therefore, the design of wide frequency band compression drivers having high efficiency, smooth frequency response and high power handling capacity is a complicated and compromised problem. Effective reproduction of high frequency signals needs light moving assembly, very small height of compression chamber and low inductance voice coil. These requirements call into question the ability of the compression driver to reproduce lower part of the mid-band frequencies, its power handling capacity, its lower distortion. That is why the prior art is characterized by the wide variety of technical solutions to improve parts of compression drivers such as phasing plug, surround, diaphragm, and magnet assembly.

U.S. Pat. No. 3,665,124 teaches a loudspeaker which includes an annular diaphragm including a vibrating portion having an arcuate shape in cross section, such as a shape of a fraction of a circle or an ellipse, and inner and outer peripheral support portions, voice coils attached to borders between the vibrating portion and the inner and outer support portions of the annular diaphragm and the magnetic circuit which has concentric gaps for receiving the voice coils, respectively, to drive the annular diaphragm in phase with the voice coils.

In FIG. 1 of U.S. Pat. No. 3,665,124 a horn loudspeaker includes an annular diaphragm supported at its inner and outer peripheries by a frame, a voice coil attached to the diaphragm, a magnetic circuit for driving the voice coil, a diaphragm cover and an equalizer. The same construction can be used in a direct radiating loudspeaker which has a larger diaphragm. In the horn loudspeaker the borders between the support or edge portions and the vibrating portion of the diaphragm are not driven, so that the vibration of the support or edge portions effects the vibration of the vibrating portion of the diaphragm. If the vibration of the support portions acts on the vibrating portion in opposite phase, there may be caused deep dips in the frequency characteristics of the loudspeaker. The peripheral part of the diaphragm is weak since it is supported through the soft support portion, so that the diaphragm is liable to produce free vibration, resulting in turbulence in the frequency characteristics. A light and rigid diaphragm can be obtained, since the vibrating portion of the diaphragm has increased rigidity owing to the arcuate shape in cross section. The vibrating portion of the diaphragm is effectively separated from the support portions by the border driven by the voice coils, so that the vibration of one of them has minimum effect on the other. Accordingly a relatively smooth frequency characteristic can be obtained, without turbulence or distortion owing to the influence of the support portions. The vibrating area can be increased, compared with the conventional dome loudspeaker. A light and strong diaphragm can be obtained with relatively large vibrating area. Accordingly, the efficiency can be also increased. The frequency range of the piston motion of the diaphragm can be materially increased, thereby providing a loudspeaker having high fidelity and non-directional property. The inside and outside voice coils of the diaphragm and the flux density in the corresponding gaps of the magnetic circuit can be so selected that the diaphragm may vibrate under best and balanced state. Thus a loudspeaker can provide good tone with minimum distortion. The inputs to the inside and outside voice coils can be adjusted so that best characteristic may be obtained. That is, unbalance in operation of the inner and the outer support portions of the diaphragm can be controlled so that the diaphragm may produce perfect piston motion. Such a control cannot be performed in the conventional annular-diaphragm loudspeaker. A horn speaker has such advantageous properties as large vibrating area, high rigidity, low mass and increased driving force, so that radiation efficiency is high and substantially flat characteristic is obtained in the higher frequency range. The horn loudspeaker, having large vibrating area, light weight and rigid construction, is particularly suitable to a loudspeaker having a short horn, wherein the size or length of the horn can be made substantially smaller or shorter.

This compression driver has an improved phasing plug. The improved impedance match provided by the phasing plug allows more acoustic power to be transferred from the diaphragm, particularly at low frequencies. The phasing plug reduces the apparent size of the annular diaphragm, thus improving high frequency response and dispersion. In most applications, the throat diameter at the horn is small compared to the diameter of the annular diaphragm. The phasing plugs for use with compression drivers driven by an annular or ring diaphragm have consisted of a plug having an annular slot located next to, and concentric with, the annular ring diaphragm. The phase plug contained an annular, axially symmetric passageway connecting the annular slot to the mouth of the horn. The annular passageway typically expanded in cross section from the diaphragm to the throat so as to nearly cover the entire throat of the horn. However, the phasing plug utilizing an annular slot adjacent to the diaphragm exhibits poor dispersion characteristics at higher frequencies because the apparent size of the source is large compared to the wavelength.

U.S. Pat. No. 5,537,481 teaches a horn driver which includes a driver body and pole piece positioned therein. A throat extends through the pole piece along a longitudinal axis through the horn driver. A magnet assembly, attached to the driver body, is positioned above the upper portion of the pole piece and spaced therefrom to define a diaphragm chamber. A disk-shaped diaphragm is placed above the diaphragm chamber and is spaced from the pole piece and below and spaced from the magnet assembly. The diaphragm is attached to the magnet assembly solely at a central support area. The diaphragm has a ring-like and vibratable portion extending radially outward from the central support area to an outer peripheral edge and a voice coil connected to a cylindrical voice coil support along the outer peripheral edge of the diaphragm. The portion of the diaphragm includes an inner diaphragm segment extending upwardly and outwardly from the central support area to a peak point and an outer diaphragm segment extending downwardly and outwardly from the peak point to the outer peripheral edge. The upper portion of the pole piece has an upper surface shaped similar to and following the diaphragm portion. The spacing between the diaphragm portion and the pole piece increases continuously in a non-linear manner from a minimum near the peripheral edge to a maximum near the central support area. The horn driver includes a device for generating a magnetic field passing through the voice coil and electrical connections to the voice coil.

U.S. Pat. No. 4,325,456 teaches a phasing plug as an acoustic transformer. The phasing plug has the general shape of a doubly truncated cone with an annular surface located on the larger end of the truncated cone and positioned adjacent to the diaphragm. The conical surface of the cone has spaced radial slots or channels formed therein connecting the truncated surfaces of the cone. These channels form air passageways for propagation of sound waves. The walls of the slots or channels are tapered such that the cross-sectional areas of the channels increase from their inlet ends near the speaker diaphragm, towards the outlet ends, positioned at the throat of the horn. The phasing plug provides a mechanical impedance match between the output of the annular diaphragm and the input of the horn.

Traditionally, the compression drivers are limited to use with either convex or concave-domed, diaphragms. While spherical shell diaphragms are suitable for use in high frequency loudspeakers, it has been found that such diaphragms are typically inappropriate for use with mid-range frequency loudspeakers. For example, a typical mid-range driver requires a 50 to 70 square inch diaphragm surface in order to generate appropriate frequency signals. Since spherical shell diaphragms are vibrated by means of voice coils around the perimeter thereof, a mid-range driver incorporating such a spherical shell diaphragm would require an inordinately large voice coil. The cost and weight of a magnet structure driving the voice coil is generally deemed to be prohibitive.

A compression driver includes a pole piece made of ferromagnetic material which has a bore therein, the front end or opening of which is adaptable for coupling to the throat of a horn. A diaphragm, usually circular with a central dome-shaped portion, is mounted adjacent the rear opening of the bore so as to be freely vibratable. Attached to the edge of the dome of the diaphragm is a cylindrical coil of wire, the voice coil, oriented so that the cylindrical axis of the coil is perpendicular to the diaphragm and coincident with the axis of the pole piece bore. A static magnetic field, usually produced by a permanent magnet, is applied so that an alternating current flowing through the voice coil causes it to vibrate along its cylindrical axis. This in turn causes the diaphragm to vibrate along the axis of the bore and generate sound waves corresponding to the signal current. The sound waves are directed through the bore toward its front opening. The front opening of the bore is usually coupled to the throat of a horn, which then radiates the sound waves into the air. In the description that follows, the term "throat" is used to mean either the front or downstream end of the pole piece bore or the actual throat of a horn. Interposed between the diaphragm and the pole piece bore is a perforated phasing plug. Within the phasing plug are one or more air passages or channels for transmission of the sound waves. The surface of the phasing plug opposite the diaphragm is of corresponding sphericity and positioned fairly close to the diaphragm while still leaving an air gap, or compression region, in which the diaphragm can vibrate freely.

In order to provide a low reluctance magnetic pathway for the applied static magnetic field, the permanent magnet and the voice coil are disposed within a surrounding environment of ferromagnetic material. As both the magnet and voice coil are commonly located on the side of the diaphragm facing the pole piece, the magnetic pathway includes both the phasing plug and the surrounding pole piece. In order for the voice coil to be free to vibrate, however, it must be disposed within an annular air gap, which will be referred to herein as the coil space. Ideally, the coil space should be made as small as possible since air in the magnetic pathway adds reluctance to the magnetic circuit which lessens the field strength at the voice coil. Nevertheless there is a considerable volume of air in the coil space surrounding the voice coil as well as in the spaces along the inner edge of the surround and outer edge of the diaphragm, which are continuous with the coil space. This region, including the coil space and the space along the surround and outer edge of the diaphragm, is thus an uncoupled region since it is so far from the inlets of the phasing plug air passages that variations of air pressure in that region are coupled little or not at all to the phasing plug and thence to the throat. These pressure variations thus result in energy losses that lead to heating of the loudspeaker but do not result in the generation of useful sound output. The uncoupled region also causes cavity resonance effects that distort the overall sound output of the speaker due to anomalies in its frequency response. Such resonances, known as parasitic resonances, present a significant design problem for the speaker designer ("The Influence of Parasitic Resonances on Compression Driver Loudspeaker Performance" by Kinoshita, et al. presented at the 61st Convention of the Audio Engineering Society in 1978 and available as preprint no. 1422 (M-2).). It would be useful to couple the pressure variations in the uncoupled region around the voice coil to the throat of the horn, in addition to the pressure variations produced by the diaphragm, to improve the efficiency and sound quality of the loudspeaker. Use of the additional pressure variations could be expected to reduce heating in the region around the voice coil as a result of repeated compression and rarefaction of the same air in that region, to produce an increase in the efficiency of the loudspeaker, and to reduce parasitic resonances.

SUMMARY OF INVENTION

The present invention is generally directed to a compression driver which includes a magnet assembly with a magnetic gap and an annular diaphragm with a voice coil. The voice coil is disposed in the magnetic gap of the magnet assembly. The magnetic assembly supplies a magnetic field to the voice coil.

In a first, separate aspect of the present invention, the annular diaphragm has a first support portion, a second support portion, a first curved resilient portion, a second curved resilient portion and a voice coil support portion. The voice coil support portion is disposed between the first and second resilient curved portions. The voice coil is wound on the voice coil support portion of the annular diaphragm. The voice coil is disposed in the magnetic gap of the magnet assembly.

In a second, separate aspect of the present invention, the compression driver also includes an inner support ring and an outer support ring which are coupled to the magnet assembly. The inner support ring has a bottom surface with a first curved groove. The outer support ring has a bottom surface with a second groove. The outer support ring is disposed concentrically around the inner support ring. The outer support ring is disposed adjacent, but not contiguous, to the inner support ring so that a concentric air gap is formed between the inner and outer support rings. The first and second support portions of the annular diaphragm are clamped between the inner and outer support rings, respectively. The first and second resilient curved portions are disposed adjacent, but not contiguous, to the first and second grooves of the inner and outer support rings, respectively, to form an expanding/contracting cavity of air. The expanding/contracting cavity of air is fluidly coupled to the concentric air gap.

In a third, separate aspect of the present invention, the magnet assembly includes a pole piece element, a top plate element and a magnet. The pole piece element and the top plate element together form the magnetic gap. The magnet supplies a magnetic field through the pole piece and the top plate element.

In a fourth, separate aspect of the present invention, the central plug is mechanically coupled to the inner support ring and the magnet assembly. The central plug is annular. A housing is mechanically coupled to the outer support ring and the magnet assembly. The housing is annular and has a throat having a first open end of a first diameter, a second open end of a second diameter which is smaller than the first diameter and an inner surface which is concentrically aligned with the outer surface of the central plug. The outer surface of the central plug and the throat of the housing form a concentric air gap which is disposed adjacent to the first open end of the throat of the housing and is also disposed adjacent and contiguous to the concentric air gap.

In a fifth, separate aspect of the present invention the central plug has an outer surface in the shape of a "candy kiss."

In a sixth, separate aspect of the present invention the central plug has an outer surface in the shape of a bullet.

In a seventh, separate aspect of the present invention the central plug has an outer surface in the shape of a cone.

Other aspects and many of the attendant advantages will be more readily appreciated as the same becomes better understood by reference to the following detailed description and considered in connection with the accompanying drawings in which like reference symbols designate like parts throughout the figures.

The features of the present invention which are believed to be novel are set forth with particularity in the appended claims.

DESCRIPTION OF THE DRAWINGS

FIG. 5 is a partial cross-section of an elevation view of the compression driver of FIG. 4.

FIG. 6 is a cross-section of an elevation view of a compression driver having an annular diaphragm according to U.S. Pat. No. 4,325,456.

DESCRIPTION OF THE PREFERRED EMBODIMENT

Figure 1:
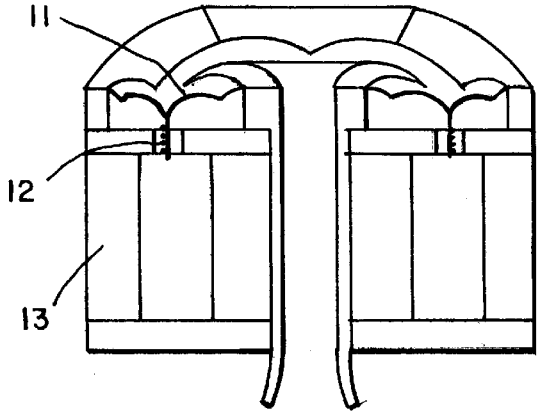
Fig. 1. (PRIOR ART)
FIG. 1 is a cross-section of an elevation view of a compression driver according to U.S. Pat. No. 3,665,124.

Referring to FIG. 1 U.S. Pat. No. 3,665,124 describes a compression driver 10. The compression driver 10 includes an annular diaphragm 11, a voice coil 12 and a magnet 13.

Figure 2:
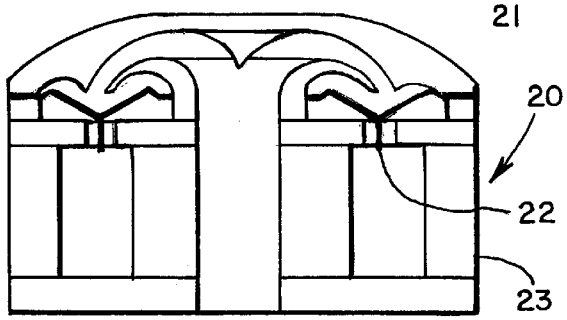
Fig. 2. (PRIOR ART)
FIG. 2 is a cross-section of an elevation view of a compression driver according to a description by Harry F. Olson in his book, *Acoustical Engineering*.

Referring to FIG. 2 in conjunction with FIG. 1 Harry F. Olson describes a compression driver 20 in FIG. 7.28D of his book, entitled *Acoustical Engineering,* D. Van Nostrand Company, Inc., 1957, at page 242. The compression driver 20 includes an annular diaphragm 21, a voice coil 22 and a magnet 23. The compression driver 20 is similar to the compression driver 10.

Figure 3:
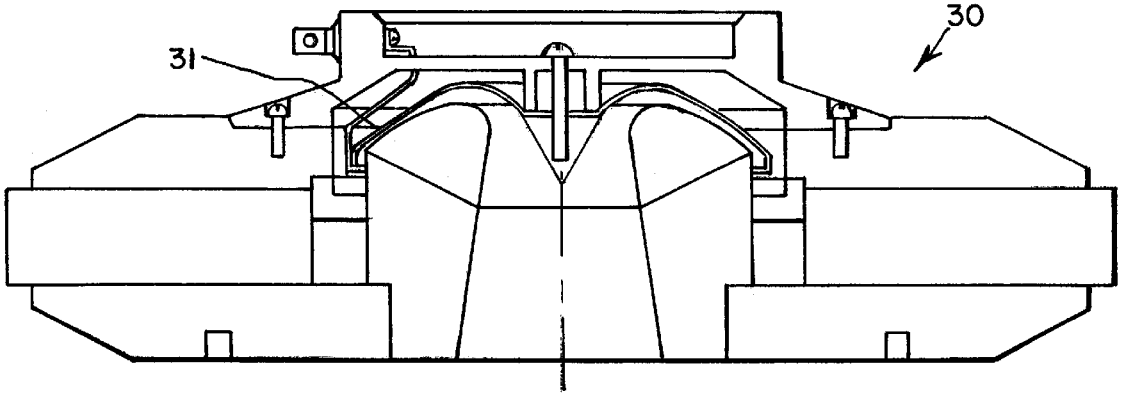
Fig. 3. (PRIOR ART)
FIG. 3 is a cross-section of an elevation view of a compression driver according to U.S. Pat. No. 5,537,481.

Referring to FIG. 3 a compression driver 30 has an annular diaphragm 31. The cross-section of the annular diaphragm 31 is in shape of an apple top. U.S. Pat. No. 5,537,481 teaches the compression driver 30.

Figure 4:
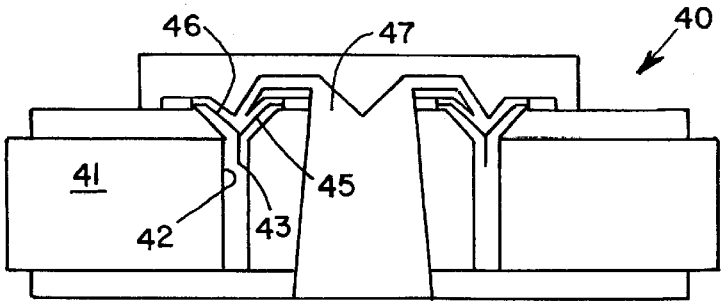
Fig. 4. (PRIOR ART)
FIG. 4 is a schematic drawing of a compression driver according to U.S. Pat. No. 5,878,148.

Referring to FIG. 4 in conjunction with FIG. 5 a compression driver 40 includes a magnetic system 41 having an annular air gap 42, a voice coil 43 and an annular diaphragm 45. The voice coil 43 can move in the annular air gap 42 of the magnetic system 41 with the annular diaphragm 45 being driven by the voice coil 43. The diaphragm 45 and a compression chamber 46 are of annular design. The compression chamber 46 is connected to a central sound output channel 47 around its perimeter. The annular design of the annular diaphragm 45 provides it with a large effective surface area and a small mass. The feed power is therefore relatively low, resonant frequency is high thereby improving the fidelity of high frequencies. This is especially true if the annular diaphragm 45 is V-shaped and is preferably curved towards the acute angle enclosed by it. U.S. Pat. No. 5,878,148 teaches the compression driver 40.

Figure 7:
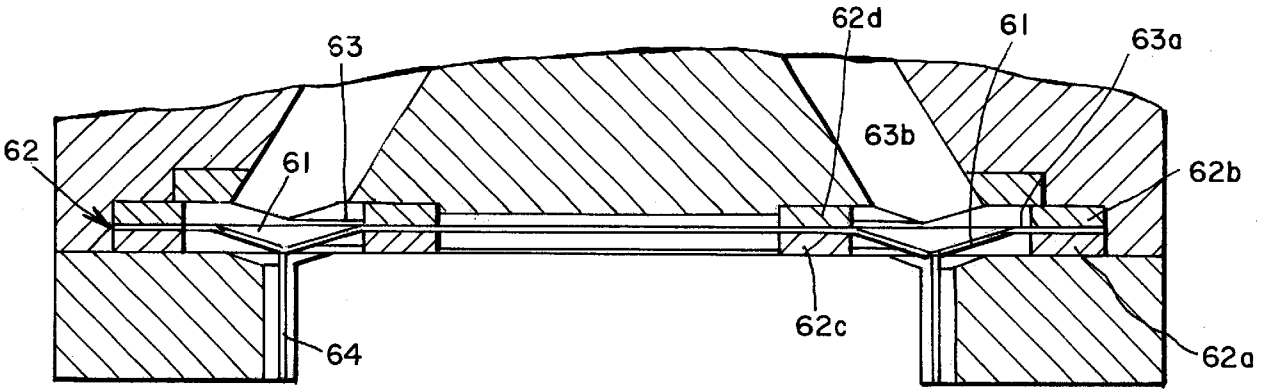
Fig. 7. (PRIOR ART)
FIG. 7 is an enlarged cross-section of an elevation view of the annular diaphragm of FIG. 6.

Referring to FIG. 6 in conjunction with FIG. 7 a compression driver 60 includes an annular diaphragm 61 with a coil support portion, support rings 62, a suspension system 63 and a voice coil 64. The diaphragm 61 is V-shaped. The support rings 62 include parts 62*a,* 62*b,* 62*c* and 62*d.* The suspension system 63 includes flexible annular members 63*a* and 63*b.* The annular diaphragm 61 is resiliently mounted between the support rings 62 by the suspension system 63. The voice coil 64 is wound on the coil support portion of the annular diaphragm 61 and is located in a magnetic gap formed between two pole piece elements 65 and 66. The compression driver 60 also includes a phasing plug 67 with an outer surfaces 67*a,* 67*b,* 67*c,* 67*d,* 67*e* and 67*f* and a throat 68 with a mating surface 68*a,* a magnet 69 and a housing 70. The phasing plug 67 is mounted with a portion of its conical, outer surface 67*a* in abutment against the mating surface 68*a* of the throat 68. The phasing plug 67 is disposed above the annular diaphragm 61 inside the throat 68. However, the outer surface 67*a* and the mating surface 68*a* need not be conical in shape, although they should be located substantially adjacent to each other. The central portion of the inner periphery of the phasing plug 67 is formed by the conical surface of portion 67*b* of the phasing plug 67. The outer surface 67*c* of the phasing plug 67 is in the form of an annular ring having a surface contour which conforms substantially to the shape of the annular diaphragm 61 and which is positioned opposite to and concentric with the annular diaphragm 61. A part of the surface 67*d* of the central portion of the phasing plug 67 is also in the form of an annular ring and abuts against the inner portion of the support ring 62*d* forming an airtight seal with ring 62*d.* The surface 67*e* of the phasing plug 67 in the form of an annular ring abuts against the support ring 62*b* forming an outer, airtight seal with the support ring 62*b.* The opposite surface 67*f* of the phasing plug 67 is a planar flat end of the truncated cone. The magnet 69 supplies the magnetic field through the housing 70 to the two pole piece elements 65 and 66. U. S. Patent No. 4,325,456 teaches the compression driver 60.

Figure 8:
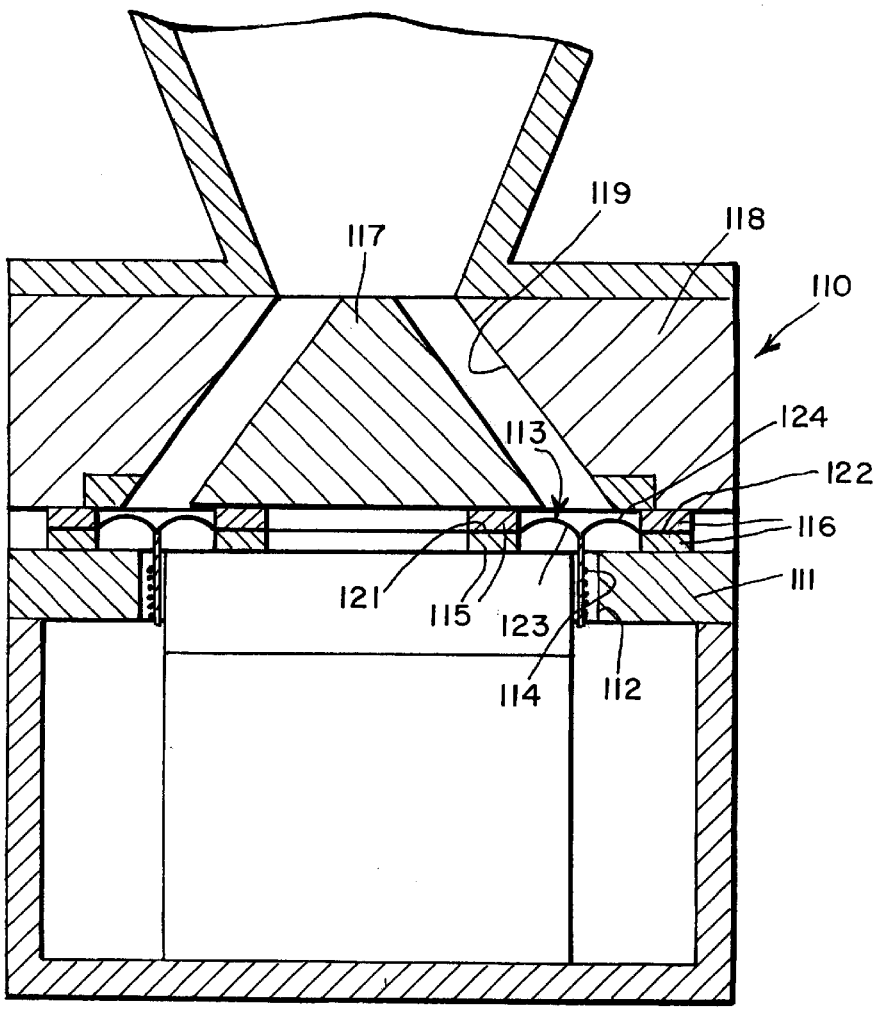
FIG. 8 is a cross-section of an elevation view of a compression driver having an annular diaphragm according to the first embodiment.
Figure 9:
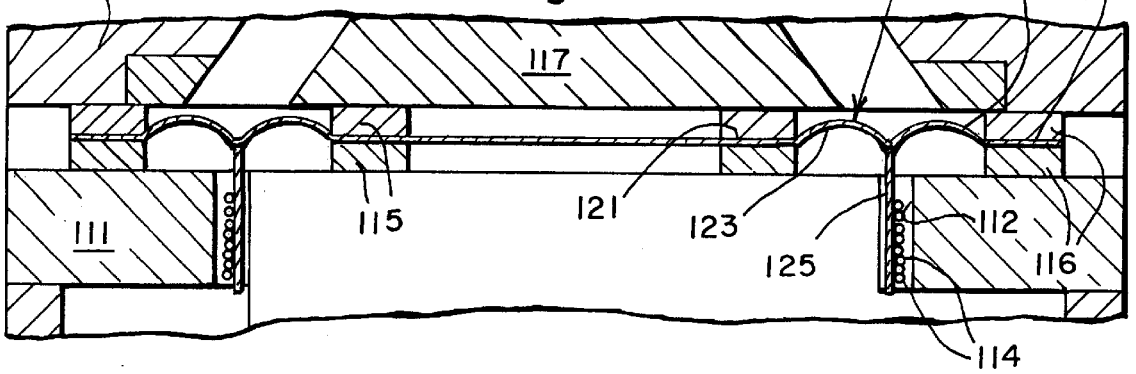
FIG. 9 is an enlarged cross-section of an elevation view of the annular diaphragm of FIG. 8.

Referring to FIG. 8 in conjunction with FIG. 9 a compression driver 110 includes a magnet assembly 111 with a magnetic gap 112, an annular diaphragm 113 with a voice coil 114, an inner support ring 115, an outer support ring 116, a central plug 117, a housing 118 with a throat 119 and a horn 120. The annular diaphragm 113 has a first coil support portion 121, a second coil support portion 122, a first curved resilient portion 123, a second resilient curved portion 124 and a voice coil support portion 125. The voice coil support 125 is disposed between the first and second resilient curved portions 123 and 124. The first and second support portions 121 and 122 are clamped between the inner and outer support rings 115 and 116, respectively. The central plug 117 is disposed in the throat 119 of the housing 118. The horn 120 is acoustically coupled to the throat 119 of the housing 118.

Figure 10:
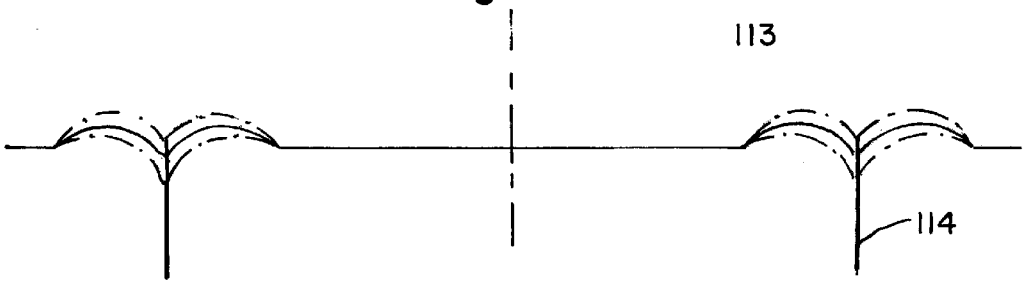
FIG. 10 is a schematic drawing of the movement of the annular diaphragm of FIG. 8.

Referring to FIG. 10 in conjunction with FIG. 9 the diaphragm 113 is flexible. The changing magnetic field in the magnetic gap vertically drives the diaphragm 113 and the voice coil 114 so that the diaphragm 113 gradually changes in order to provide a distributed bending of the entire diaphragm 113.

Figure 13:
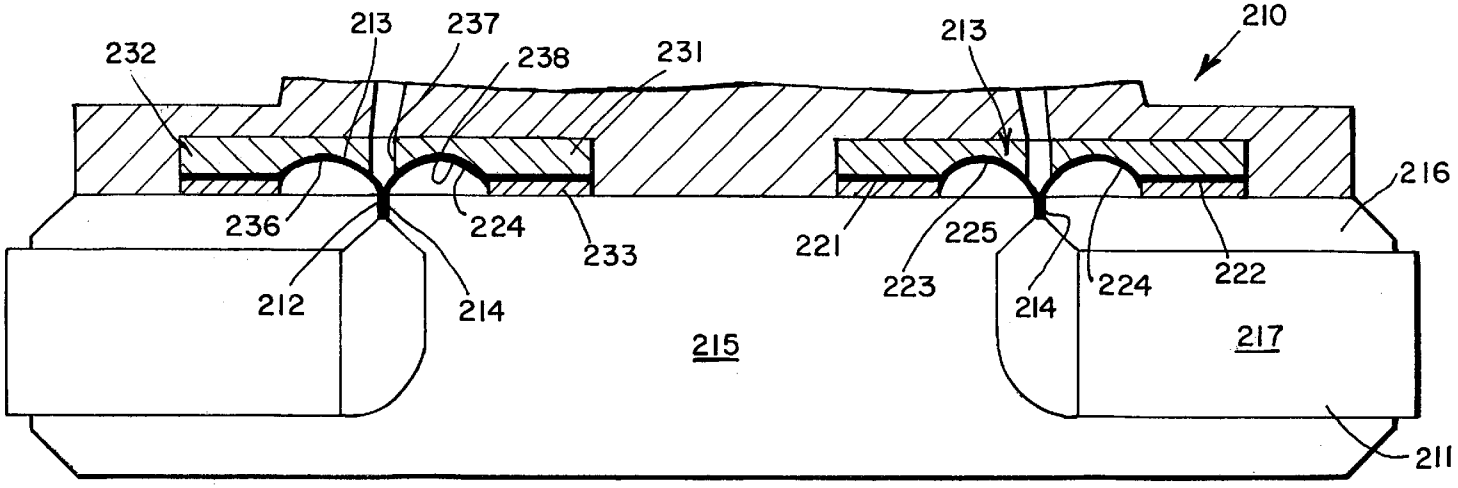
FIG. 13 is an enlarged cross-section of an elevation view of the annular diaphragm of FIG. 11.
Figure 11:
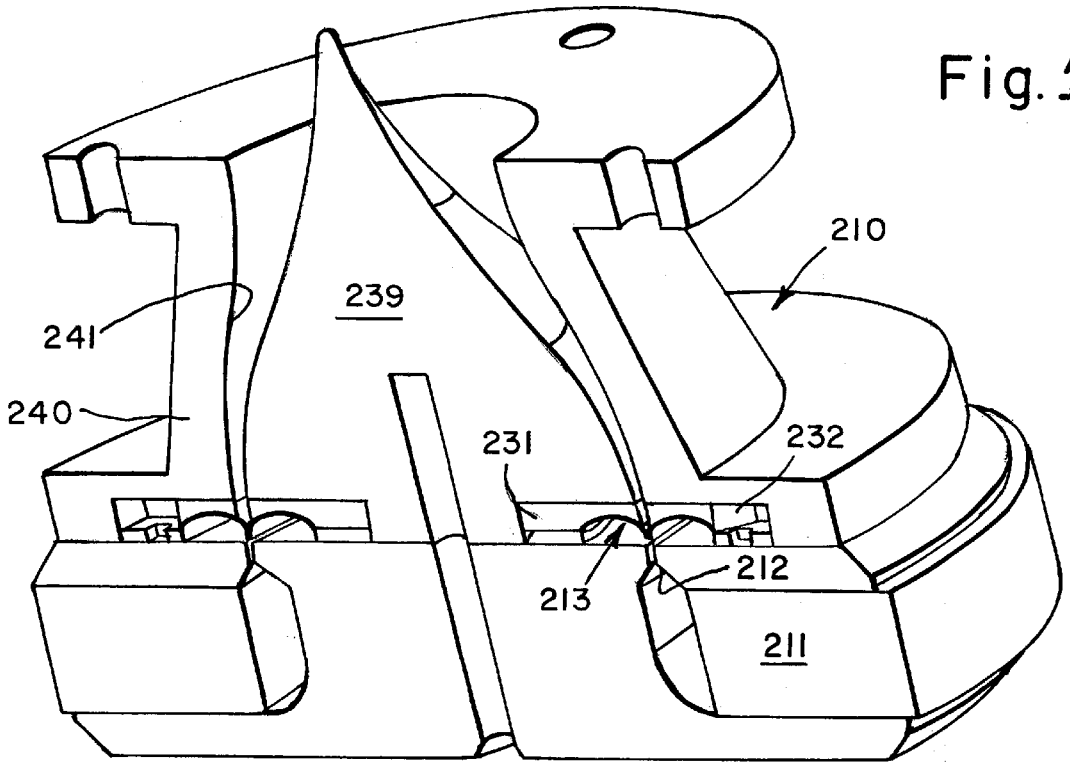
FIG. 11 is a cross-section of a perspective drawing of a compression driver having an annular diaphragm according to the second embodiment.
Figure 12:
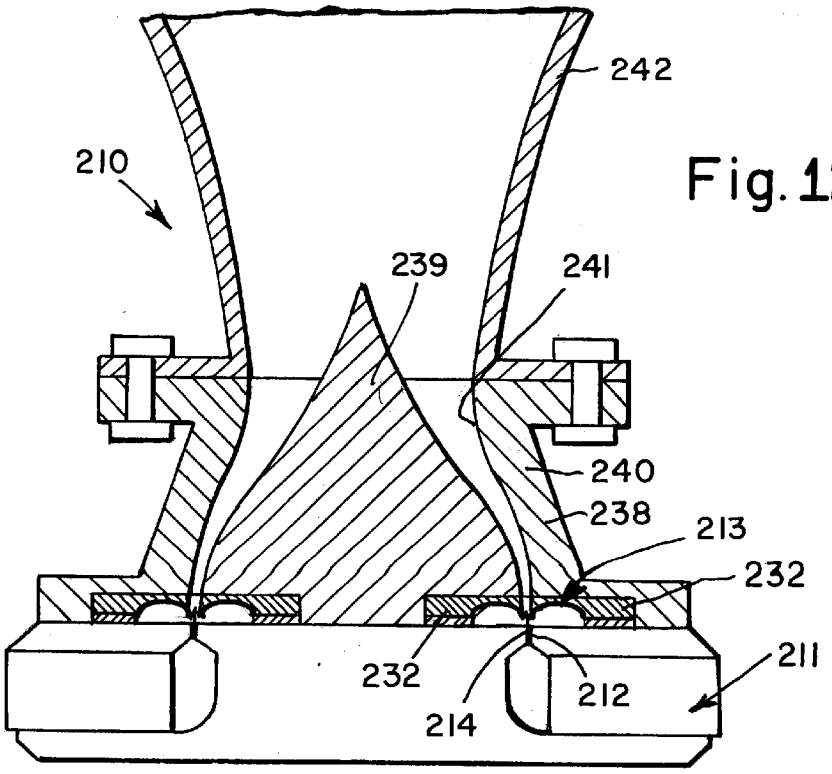
FIG. 12 is a cross-section of an elevation view of the compression driver of FIG. 11.

Referring to FIG. 11 in conjunction with FIG. 12 and FIG. 13 a compression driver 210 includes a magnet assembly 211 with a magnetic gap 212 and an annular diaphragm 213 with a voice coil 214. The magnetic assembly 211 includes a pole piece element 215, a top plate element 216 and a magnet 217 and together they form the magnetic gap 212. The magnet 217 supplies a magnetic field through the pole piece element 215 and the top plate element 216 to the voice coil 214. The annular diaphragm 213 has a first coil support portion 221, a second coil support portion 222, a first curved resilient portion 223, a second resilient curved portion 224 and a voice coil support portion 225. The voice coil support 225 is disposed between the first and second resilient curved portions 223 and 224. The voice coil 214 is wound on the coil support portion 225 of the annular diaphragm 213. The voice coil 214 and the voice coil portion 225 of the annular diaphragm 213 are disposed in the magnetic gap 212 of the magnetic assembly 211. The compression driver 210 also includes an inner support ring 231 and an outer support ring 232 which are coupled to the magnetic assembly 211. The inner support ring 231 has a bottom surface 233 and a first curved groove 234 in the bottom surface 233. The outer support ring 232 has a bottom surface 235 and a second curved groove 236 in the bottom surface 235. The outer support ring 232 is disposed concentrically around the first support ring 231. The outer support ring 232 is disposed adjacent, but not contiguous, to the inner support ring 231 so that a concentric air gap 237 is formed between the inner and outer support rings 231 and 232. The first and second support portions 221 and 222 of the annular diaphragm 213 are clamped between the inner and outer support rings 231 and 232, respectively. The first and second resilient curved portions 223 and 224 are disposed adjacent, but not contiguous, to the first and second grooves 234 and 236 of the inner and outer support rings 231 and 232, respectively, to form an expanding/contracting cavity 238 of air. The expanding/contracting cavity 238 of air is fluidly coupled to the concentric air gap 237. The compression driver further includes a central plug 239, a housing 240 with a throat 241 and a horn 242. The central plug 239 is mechanically coupled to the inner support ring 231 and the magnetic assembly 211. The central plug 239 is annular and has an outer surface in the shape of a "candy kiss". The housing 240 is mechanically coupled to the outer support ring 232 and the magnetic assembly 211. The housing 240 is annular and has a throat having a first open end of a first diameter, a second open end of a second diameter which is smaller than the first diameter and an inner surface which is concentrically aligned with the outer surface of the central plug 239. The outer surface of the central plug 239 and the throat 241 of the housing 240 form a concentric air gap 243 which is disposed adjacent to the first open end of the throat 241 of the housing 240 and is also disposed adjacent and contiguous to the concentric air gap 237. The horn 242 is acoustically coupled to the throat 241 of the housing 240.

Referring to FIG. 11 in conjunction with FIG. 12, FIG. 13 and FIG. 3 the principal difference between the compression driver 210 and the compression driver 30 is that the compression driver 30 has an annular diaphragm 31 which is shaped like an "apple top". The operation of the compression driver 30 is based on the distributed motion of the annular diaphragm 31. However, the compression driver 30 has several short-comings which are not inherent in the compression driver 210. The compression driver 30 has an air cavity with two outputs. One of the outputs opens into the horn on one side (internal diameter). On the other side (in the vicinity of the voice coil, at a larger diameter) the air cavity opens into the voice-coil gap. The second opening decreases the sound pressure in the chamber, shunting it by the voice coil gap. To prevent a decrease of sound pressure, the voice coil gap must be sealed by the ferro-fluid which becomes an essential part of the compression driver 30 due to its "sealing" properties. On the contrary in the compression driver 210 the air cavity is separated from the voice coil gap by the annular diaphragm 213 of the compression driver 210 so that the compression driver 210 either may or may not require the use of ferro-fluid. The air gap of the compression driver 30 has to have an increase towards the voice coil gap in order to provide the necessary space for the displacement of the annular diaphragm 31, but not towards the output of the chamber, as it is inherent to the annular diaphragm 213. This inverse increase of the height of the air cavity partly constricts the cavity thereby producing extra air compression and correspondingly, extra compression distortion. The additional outer curvature of the annular diaphragm 213 adds extra dynamic stability. The annular diaphragm 213 is less prone to rocking because it has two circular clampings (the inner one and the outer one) as compared to the diaphragm 31 which is secured by only one internal clamping. In order for the annular diaphragm 31 to have an efficient area which is equal to that of the annular diaphragm 213 the annular diaphragm 31 would need to have a larger radial dimension between its clamped edge and the output of the air cavity. The larger the distance between the output of the air cavity and its closed side, the lower the first resonance of the high frequency standing waves that occur in the air cavity. This first resonance produces notches on the frequency response. Since the radial dimension of the air cavity of the annular diaphragm 213 (between its closed sides and the output) is about twice as short as compared to the cavity of the annular diaphragm 31 of the same area, the first air resonance in the chamber is characterized by a frequency approximately twice as high which extends the upper part of the frequency range. Therefore, the compression driver 210 has a much higher frequency range.

Figure 14:
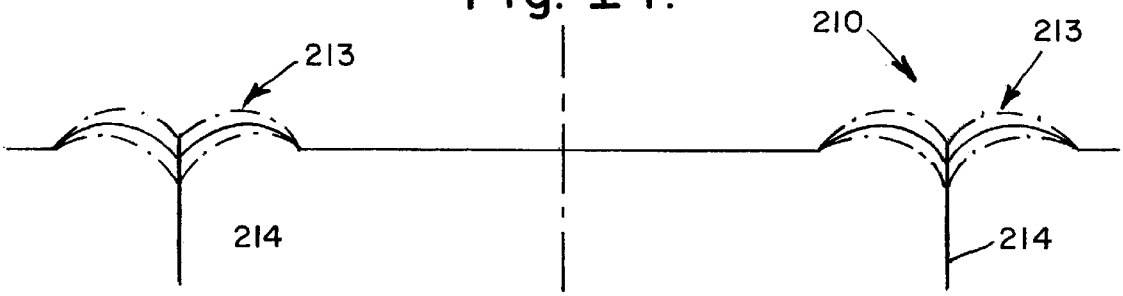
FIG. 14 is a schematic drawing of the movement of the annular diaphragm of FIG. 11.

Referring to FIG. 14 in conjunction with FIG. 13 the diaphragm 213 is flexible. The changing magnetic field in the magnetic gap vertically drives the diaphragm 213 and the voice coil 214 so that the diaphragm 213 gradually changes in order to provide a distributed bending of the entire diaphragm 213.

Figure 15:
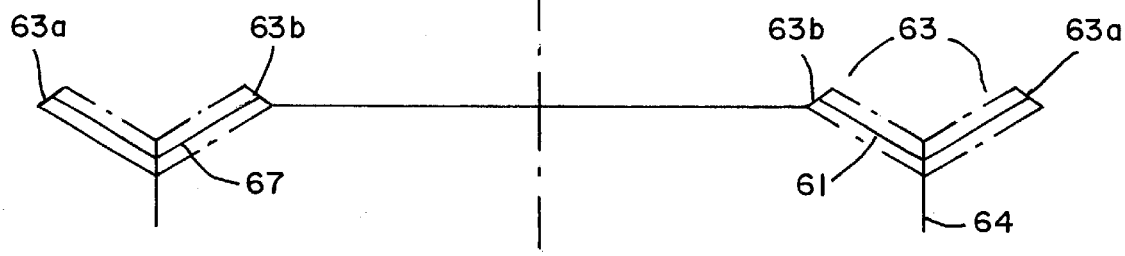
Fig. 15. (PRIOR ART)
FIG. 15 is a schematic drawing of the movement of the annular diaphragm of FIG. 6.

Referring to FIG. 15 in conjunction with FIG. 7 the diaphragm 61 is stiff and the suspension system 63 is flexible. The changing magnetic field in the magnetic gap vertically drives the diaphragm 61 and the voice coil 64 so that diaphragm 61 retains its V-shape and the suspension system 63 is so stressed that it does not retains its shape.

Referring to FIG. 11, FIG. 12, FIG. 13 and FIG. 14 in conjunction with FIG. 6, FIG. 7 and FIG. 14 the principal difference between the compression driver 210 and the compression driver 60 is that the compression driver 60 includes an annular diaphragm 61 which is in the shape of a V-shaped ring and has an external elastic surround 62. The surround 62 provides mechanical compliance for the annular diaphragm 61. The annular diaphragm 61 is supposed to be as rigid as possible to vibrate as a solid shell. The annular diaphragm 61 actually performs "acoustical" functions. The surround 62 is supposed to perform only "mechanical" functions, helping the annular diaphragm 61 to vibrate linearly. However, the surround 62 adds extra mass to the annular diaphragm 61. The extra mass decreases the amplitudes of both the excursion of the annular diaphragm 61 and the velocity at high frequencies thereby attenuating reproduction of the acoustical signal at high frequencies.

Contrary to the design of the annular diaphragm 61 of the compression driver 60, the annular diaphragm 213 of the compression driver 210 "consolidates" the diaphragm and the surround functions into a single assembly. To that end, the annular diaphragm 213 provides linear excursion with low mechanical distortion, because the whole body of the annular diaphragm 213 acts as a big surround. It is the surround that radiates the sound waves. The mechanical movement of the annular diaphragm 213 is that of a distributed body, rather than a movement of a rigid diaphragm suspended on the external elastic surround. Another advantage is the way the new air cavity is configured. Due to the specific shape of the annular diaphragm 213 and the way it is clamped, the maximum displacement of the annular diaphragm 213 occurs in the vicinity of the voice coil 214 and the minimum displacement occurs at the outer and inner rims, where the annular diaphragm 213 is clamped.

In the compression driver 60 the height of the air cavity is uniform, whereas in the compression driver 210, the height of the chamber is shorter at the outer and inner rims, gradually increasing towards the output of the air cavity (in other words, to the input of the horn). If the height of the air cavity gradually increases towards the horn, following the vibrating pattern of the annular diaphragm 213, a minimum amount of air is enclosed in the air cavity. The smaller the volume of air in the cavity, the greater the high frequency signal that is reproduced, and vice versa: the larger the volume, the smaller the high frequency signal that is reproduced. The volume of the air cavity of compression driver 210 is minimal, therefore securing the reproduction of high frequencies. However, the compression of the air in the cavity is essentially a non-linear process associated with the generation of non-linear and inter-modulation distortion of the sound pressure signal. In other words, the air trapped in the cavity acts as a non-linear "spring", and only a part of it is displaced into the horn. If all air of the cavity was displaced from the cavity, there would be no air compression distortion. In the air cavity of compression driver 210, the air compression distortion is low, because the air is partly compressed and partly displaced from the cavity into the horn. This phenomenon results from the expansion of the displacement vector of the annular diaphragm 213 into two orthogonal components in the X-Y plane. The X-component does not produce air compression distortion. Therefore, the air cavity provides for the reproduction of high frequency signals without a strong increase in air compression distortion.

Figure 16:
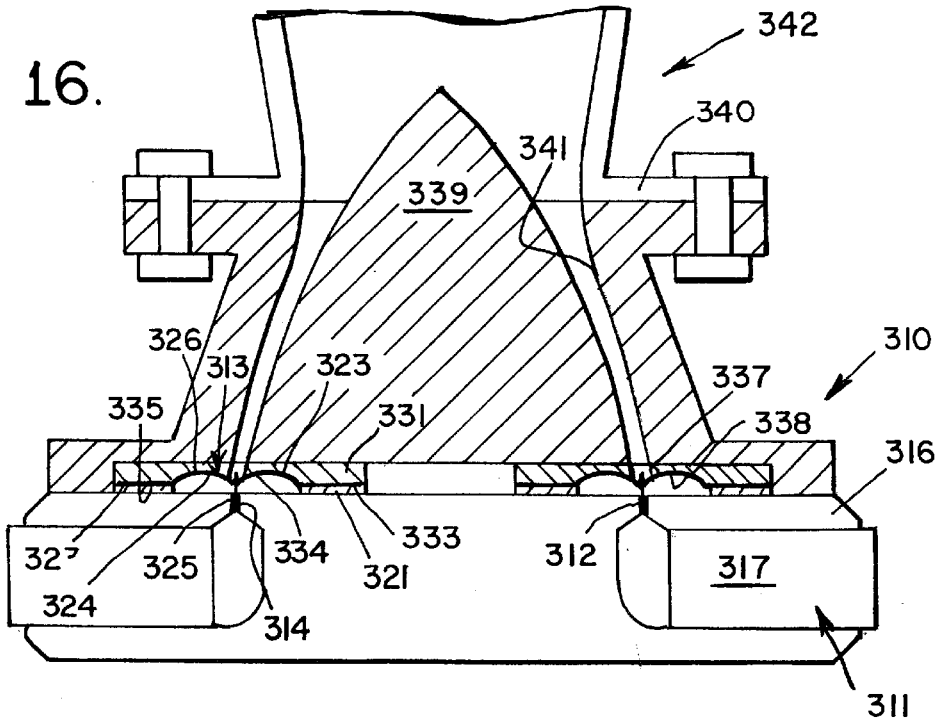
FIG. 16 is a cross-section of an elevation view of a compression driver according to the third embodiment.

Referring to FIG. 16 a compression driver 310 includes a magnet assembly 311 with a magnetic gap 312 and an annular diaphragm 313 with a voice coil 314. The magnetic assembly 311 includes a pole piece element 315, a top plate element 316 and a magnet 317 and together they form the magnetic gap 312. The magnet 317 supplies a magnetic field through the pole piece element 315 and the top plate element 316 to the voice coil 314. The annular diaphragm 313 has a first coil support portion 321, a second coil support portion 322, a first curved resilient portion 323, a second resilient curved portion 324 and a voice coil support portion 325. The voice coil support 325 is disposed between the first and second resilient curved portions 323 and 324. The voice coil 326 is wound on the coil support portion 325 of the annular diaphragm 313. The voice coil 326 and the voice coil portion 325 of the annular diaphragm 313 are disposed in the magnetic gap 312 of the magnetic assembly 311. The compression driver 310 also includes an inner support ring 331 and an outer support ring 332 which are coupled to the magnetic assembly 311. The inner support ring 331 has a bottom surface 333 and a first curved groove 334 in the bottom surface 333. The outer support ring 332 has a bottom surface 335 and a second curved groove 336 in the bottom surface 335. The outer support ring 332 is disposed concentrically around the first support ring 331. The outer support ring 332 is disposed adjacent, but not contiguous, to the inner support ring 331 so that a concentric air gap 337 is formed between the inner and outer support rings 331 and 332. The first and second support portions 321 and 322 of the annular diaphragm 313 are clamped between the inner and outer support rings 331 and 332, respectively. The first and second resilient curved portions 323 and 324 are disposed adjacent, but not contiguous, to the first and second grooves 334 and 336 of the inner and outer support rings 331 and 332, respectively, to form an expanding/contracting cavity 338 of air. The expanding/contracting cavity 338 of air is fluidly coupled to the concentric air gap 337. The compression driver further includes a central plug 339, a housing 340 with a throat 341 and a horn 342. The central plug 339 is mechanically coupled to the inner support ring 331 and the magnetic assembly 311. The central plug 339 is annular and has an outer surface in the shape of a bullet. The housing 340 is mechanically coupled to the outer support ring 332 and the magnetic assembly 311. The housing 340 is annular and has a throat having a first open end of a first diameter, a second open end of a second diameter which is smaller than the first diameter and an inner surface which is concentrically aligned with the outer surface of the central plug 339. The outer surface of the central plug 339 and the throat 341 of the housing 340 form a concentric air gap 343 which is disposed adjacent to the first open end of the throat 341 of the housing 340 and is also disposed adjacent and contiguous to the concentric air gap 337. The horn 342 is acoustically coupled to the throat 341 of the housing 340.

Figure 17:
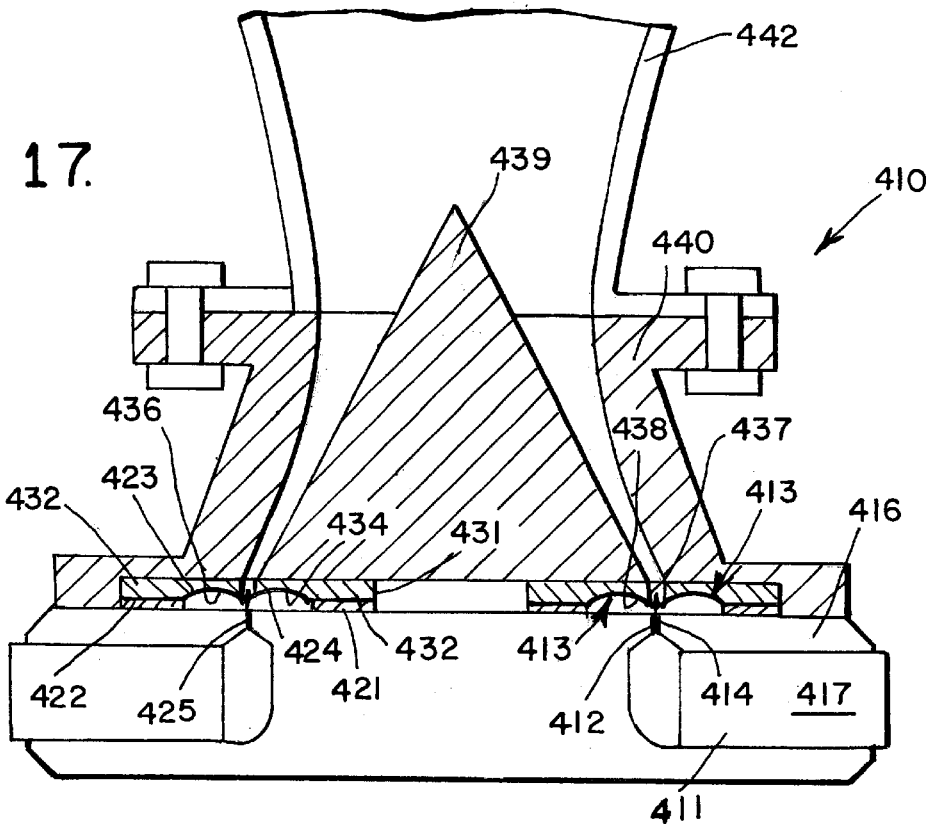
FIG. 17 is a cross-section of an elevation view of a compression driver according to the fourth embodiment.

Referring to FIG. 17 a compression driver 410 includes a magnet assembly 411 with a magnetic gap 412 and an annular diaphragm 413 with a voice coil 414. The magnetic assembly 411 includes a pole piece element 415, a top plate element 416 and a magnet 417 and together they form the magnetic gap 412. The magnet 417 supplies a magnetic field through the pole piece element 415 and the top plate element 416 to the voice coil 414. The annular diaphragm 413 has a first coil support portion 421, a second coil support portion 422, a first curved resilient portion 423, a second resilient curved portion 424 and a voice coil support portion 425. The voice coil support 425 is disposed between the first and second resilient curved portions 423 and 424. The voice coil 426 is wound on the coil support portion 425 of the annular diaphragm 413. The voice coil 426 and the voice coil portion 425 of the annular diaphragm 413 are disposed in the magnetic gap 412 of the magnetic assembly 411. The compression driver 410 also includes an inner support ring 431 and an outer support ring 432 which are coupled to the magnetic assembly 411. The inner support ring 431 has a bottom surface 433 and a first curved groove 434 in the bottom surface 433. The outer support ring 432 has a bottom surface 435 and a second curved groove 436 in the bottom surface 435. The outer support ring 432 is disposed concentrically around the first support ring 431. The outer support ring 432 is disposed adjacent, but not contiguous, to the inner support ring 431 so that a concentric air gap 437 is formed between the inner and outer support rings 431 and 432. The first and second support portions 421 and 422 of the annular diaphragm 413 are clamped between the inner and outer support rings 431 and 432, respectively. The first and second resilient curved portions 423 and 424 are disposed adjacent, but not contiguous, to the first and second grooves 434 and 436 of the inner and outer support rings 431 and 432, respectively, to form an expanding/contracting cavity 438 of air. The expanding/contracting cavity 438 of air is fluidly coupled to the concentric air gap 437. The compression driver further includes a central plug 439, a housing 440 with a throat 441 and a horn 442. The central plug 439 is mechanically coupled to the inner support ring 431 and the magnetic assembly 411. The central plug 439 is annular and has an outer surface in the shape of a cone. The housing 440 is mechanically coupled to the outer support ring 442 and the magnetic assembly 411. The housing 440 is annular and has a throat 441 having a first open end of a first diameter, a second open end of a second diameter which is smaller than the first diameter and an inner surface which is concentrically aligned with the outer surface of the central plug 439. The outer surface of the central plug 439 and the throat 441 of the housing 440 form a concentric air gap 443 which is disposed adjacent to the first open end of the throat 441 of the housing 440 and is also disposed adjacent and contiguous to the concentric air gap 437. The horn 442 is acoustically coupled to the throat 441 of the housing 440.

Figure 18:
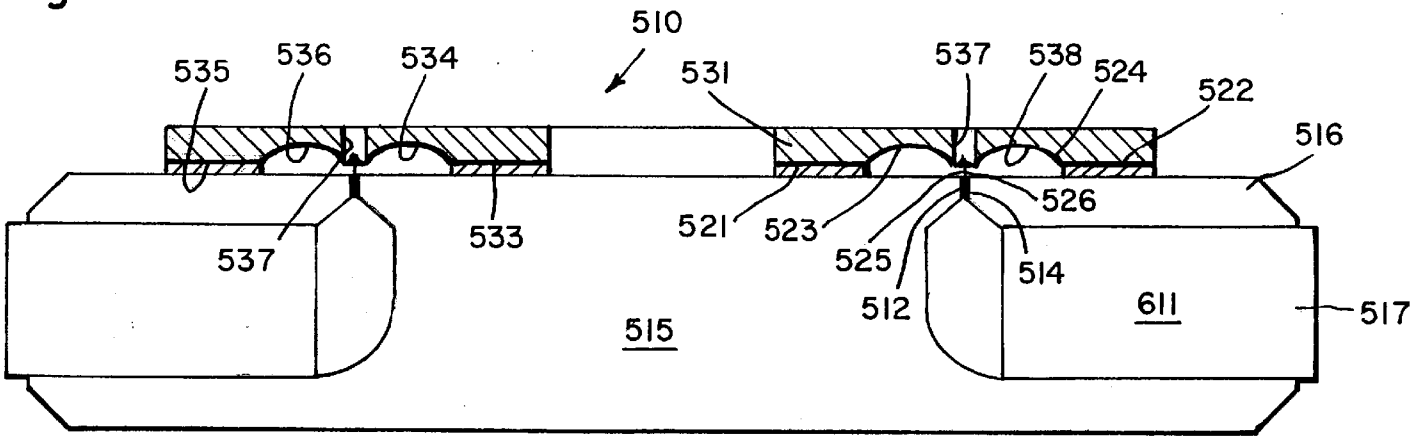
FIG. 18 is a cross-section of an elevation view of a compression driver according to the fifth embodiment.

Referring to FIG. 18 a compression driver 510 includes a magnet assembly 511 with a magnetic gap 512 and an annular diaphragm 513 with a voice coil 514. The magnetic assembly 511 includes a pole piece element 515, a top plate element 516 and a magnet 517 and together they form the magnetic gap 512. The magnet 517 supplies a magnetic field through the pole piece and the top plate element to the voice coil 514. The annular diaphragm 513 has a first coil support portion 521, a second coil support portion 522, a first curved resilient portion 523, a second resilient curved portion 524 and a voice coil support portion 525. The voice coil support 525 is disposed between the first and second resilient curved portions 523 and 524. The voice coil 526 is wound on the coil support portion 525 of the annular diaphragm 513. The voice coil 526 and the voice coil portion 525 of the annular diaphragm 513 are disposed in the magnetic gap 512 of the magnetic assembly 511. The compression driver 510 also includes an inner support ring 531 and an outer support ring 532 which are coupled to the magnetic assembly 511. The inner support ring 531 has a bottom surface 533 and a first curved groove 534 in the bottom surface 533. The outer support ring has a bottom surface 535 and a second curved groove 536 in the bottom surface 535. The outer support ring 532 is disposed concentrically around the first support ring 531. The outer support ring 532 is disposed adjacent, but not contiguous, to the inner support ring 531 so that a concentric air gap 537 is formed between the inner and outer support rings 531 and 532. The first and second support portions 521 and 522 of the annular diaphragm 513 are clamped between the inner and outer support rings 531 and 532, respectively. The first and second resilient curved portions 523 and 524 are disposed adjacent, but not contiguous, to the first and second grooves 534 and 536 of the inner and outer support rings 531 and 532, respectively, to form an expanding/contracting cavity 538 of air. The expanding/contracting cavity 538 of air is fluidly coupled to the concentric air gap 537.

Figure 19:
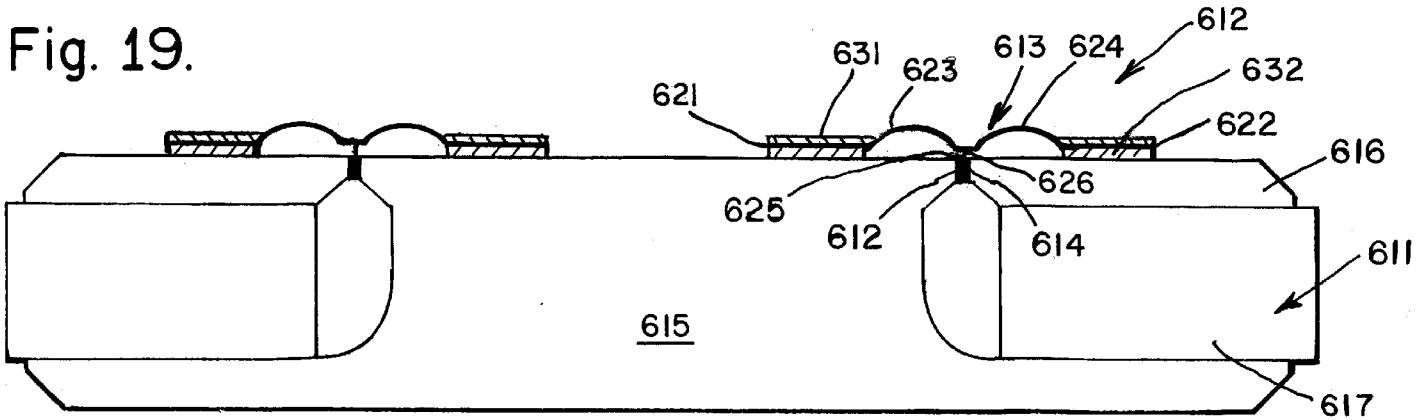
FIG. 19 is a cross-section of an elevation view of a direct radiating loudspeaker according to the sixth embodiment.

Referring to FIG. 19 a direct radiating loudspeaker 610 includes a magnet assembly 611 with a magnetic gap 612 and an annular diaphragm 613 with a voice coil 614. The magnetic assembly 611 includes a pole piece element 615, a top plate element 616 and a magnet 617 and together they form the magnetic gap 612. The magnet 617 supplies a magnetic field through the pole piece and the top plate element to the voice coil 614. The annular diaphragm 613 has a first coil support portion 621, a second coil support portion 622, a first curved resilient portion 623, a second resilient curved portion 624 and a voice coil support portion 625. The voice coil support 625 is disposed between the first and second resilient curved portions 623 and 624. The voice coil 626 is wound on the coil support portion 625 of the annular diaphragm 613. The voice coil 626 and the voice coil portion 625 of the annular diaphragm 613 are disposed in the magnetic gap 612 of the magnetic assembly 611. The compression driver 610 also includes an inner support ring 631 and an outer support ring 632. The outer support ring 632 is disposed concentrically around the first support ring 631. The first and second support portions 621 and 622 of the annular diaphragm 613 are clamped between the inner and outer support rings 631 and 632, respectively.

From the foregoing it can be seen that annular diaphragms for compression drivers have been described. It should be noted that the sketches are not drawn to scale and that the distance of and between the figures is not to be considered significant.

Accordingly it is intended that the foregoing disclosure and representations made in the drawings shall be considered only as an illustration of the principle of the present invention.

What is claimed is:

1. A compression driver comprising:

a. an annular diaphragm having a first coil support portion, a second coil support portion, a first curved resilient portion, a second resilient curved portion and a voice coil support portion wherein said voice coil support is disposed between said first and second resilient curved portions;

b. a voice coil wound on said coil support portion of said annular diaphragm;

c. a magnetic assembly having a magnetic gap in which said voice coil and said voice coil portion of said annular diaphragm are disposed;

d. an inner support ring having a bottom surface and first curved groove in said bottom surface with said inner support ring being coupled to said magnetic assembly;

e. an outer support ring having a bottom surface and a second curved groove in said bottom surface with said outer support ring being disposed concentrically around said first support ring and coupled to said magnetic assembly, wherein said outer support ring is disposed adjacent, but not contiguous, to said inner support ring so that a first concentric air gap is formed between said inner and outer support rings and wherein said first and second support portions of said annular diaphragm are clamped between said inner and outer support rings, respectively, and wherein said first and second resilient curved portions are disposed adjacent, but not contiguous, to said first and second grooves of said inner and outer support rings, respectively, to form an expanding/contracting cavity of air, with said expanding/contracting cavity of air fluidly coupled to said first concentric air gap;

f. a central plug mechanically coupled to said inner support ring and said magnetic assembly wherein said central plug is annular and has an outer surface in the shape of a "candy kiss"; and g. a housing mechanically coupled to said outer support ring and said magnetic assembly wherein said housing is annular and has a throat having a first open end of a first diameter, a second open end of a second diameter which is smaller than said first diameter and inner surface which is concentrically aligned with said outer surface of said central plug whereby said central plug and said housing form a second concentric air gap which is disposed adjacent to said first open end of said housing end and is also disposed adjacent and contiguous to said first concentric air gap.

2. A compression driver comprising:

a. an annular diaphragm having a first coil support portion, a second coil support portion, a first curved resilient portion, a second resilient curved portion and a voice coil support portion wherein said voice coil support is disposed between said first and second resilient curved portions;

b. a voice coil wound on said coil support portion of said annular diaphragm;

c. a magnetic assembly having a magnetic gap in which said voice coil and said voice coil portion of said annular diaphragm are disposed;

d. an inner support ring having a bottom surface and first curved groove in said bottom surface with said inner support ring being coupled to said magnetic assembly;

e. an outer support ring having a bottom surface and a second curved groove in said bottom surface with said outer support ring being disposed concentrically around said first support ring and coupled to said magnetic assembly, wherein said outer support ring is disposed adjacent, but not contiguous, to said inner support ring so that a first concentric air gap is formed between said inner and outer support rings and wherein said first and second support portions of said annular diaphragm are clamped between said inner and outer support rings, respectively, and wherein said first and second resilient curved portions are disposed adjacent, but not contiguous, to said first and second grooves of said inner and outer support rings, respectively, to form an expanding/contracting cavity of air, with said expanding/contracting cavity of air fluidly coupled to said first concentric air gap;

f. a central plug mechanically coupled to said inner support ring and said magnetic assembly wherein said central plug is annular and has an outer surface in the shape of a bullet; and g. a housing mechanically coupled to said outer support ring and said magnetic assembly wherein said housing is annular and has a throat having a first open end of a first diameter, a second open end of a second diameter which is smaller than said first diameter and inner surface which is concentrically aligned with said outer surface of said central plug whereby said central plug and said housing form a second concentric air gap which is disposed adjacent to said first open end of said housing end and is also disposed adjacent and contiguous to said first concentric air gap.

3. A compression driver comprising:

a. an annular diaphragm having a first coil support portion, a second coil support portion, a first curved resilient portion, a second resilient curved portion and a voice coil support portion wherein said voice coil support is disposed between said first and second resilient curved portions;

b. a voice coil wound on said coil support portion of said annular diaphragm;

c. a magnetic assembly having a magnetic gap in which said voice coil and said voice coil portion of said annular diaphragm are disposed;

d. an inner support ring having a bottom surface and first curved groove in said bottom surface with said inner support ring being coupled to said magnetic assembly;

e. an outer support ring having a bottom surface and a second curved groove in said bottom surface with said outer support ring being disposed concentrically around said first support ring and coupled to said magnetic assembly, wherein said outer support ring is disposed adjacent, but not contiguous, to said inner support ring so that a first concentric air gap is formed between said inner and outer support rings and wherein said first and second support portions of said annular diaphragm are clamped between said inner and outer support rings, respectively, and wherein said first and second resilient curved portions are disposed adjacent, but not contiguous, to said first and second grooves of said inner and outer support rings, respectively, to form an expanding/contracting cavity of air, with said expanding/contracting cavity of air fluidly coupled to said first concentric air gap;

f. a central plug mechanically coupled to said inner support ring and said magnetic assembly wherein said central plug is annular and has an outer surface in the shape of a cone; and g. a housing mechanically coupled to said outer support ring and said magnetic assembly wherein said housing is annular and has a throat having a first open end of a first diameter, a second open end of a second diameter which is smaller than said first diameter and inner surface which is concentrically aligned with said outer surface of said central plug whereby said central plug and said housing form a second concentric air gap which is disposed adjacent to said first open end of said housing end and is also disposed adjacent and contiguous to said first concentric air gap.

* * * * *